US005546633A

United States Patent [19]

Liu

[11] Patent Number: 5,546,633

[45] Date of Patent: Aug. 20, 1996

[54] HINGE

[76] Inventor: Sunny Liu, 2F., No. 37, Fu-Shin 4th Rd., Pei-to Area, Taipei, Taiwan

[21] Appl. No.: 345,742

[22] Filed: Nov. 22, 1994

[51] Int. Cl.[6] ..... E05F 1/12; E05F 1/08

[52] U.S. Cl. ..... 16/278; 16/50; 16/291; 16/293

[58] Field of Search ..... 16/50, 278, 291, 16/293, 382

[56] References Cited

U.S. PATENT DOCUMENTS 4,891,862 1/1990 Holan ..... 16/278

4,894,884 1/1990 Lautenschlager ..... 16/278

*Primary Examiner*—W. Donald Bray

*Attorney, Agent, or Firm*—Browdy and Neimark

[57] ABSTRACT

A hinge comprises a seat, an elastic pressing member, a pivoting member and a cam member. The seat is provided with a receiving space in which the pivoting end of the pivoting member and the cam member are pivoted such that the pivoting member is capable of turning on the pivoting end acting as a fulcrum, and that the cam portion of the cam member is pressed by the elastic pressing member so as to regulate the angle at which the seat and the pivoting member are caused to intersect.

2 Claims, 2 Drawing Sheets

HINGE

FIELD OF THE INVENTION

The present invention relates generally to a hinge, and more particularly to an improved hinge simple in construction.

BACKGROUND OF THE INVENTION

As shown in FIG. 1, a hinge 10 of the prior art for use as a cabinet hinge or a door hinge comprises a seat 12, an urging mechanism 16 and a pivoting member 24. The seat 12 is provided therein with a receiving space 14. The urging mechanism 16 comprises a restraining seat 18 which is disposed in the receiving space 14 such that a passageway 20 is formed respectively between the restraining seat 18 and two sides of the receiving space 14. Two urging members 22 are disposed respectively in the two passageways 20, which are provided respectively-therein with an elastic element (not shown in the drawing). These two elastic elements are intended to urge the two urging members 22 to extend outwards. The pivoting member 24 has a pivoting portion 26 provided with a cam member 28. The cam member 28 is provided respectively on both sides thereof with a cam portion 281. The pivoting member 24 and the cam member 28 are pivoted in the receiving space 14 of the seat 12 by means of a pivoting pin such that the two cam portions 281 are urged respectively by the two urging members 22. As shown in FIG. 2, the cam-shaped peripheries of the two cam portions 28 are urged respectively by the front ends of the two urging members 22. As the peripheries of the cam portions 281 are urged by the urging members 22, the pivoting member 24 and the seat 12 are caused to intersect to form a predetermined angle, thereby permitting the door to remain opened in the range of a predetermined angle. When the urging members 22 are caused to urge upholding portions 282 of the cam portions 281, the pivoting member 24 and the seat 12 are caused to intersect to form a right angle, thereby causing the door to remain closed. When the urging member 22 is caused to enter the upholding portion 282 via the periphery of the cam portion 281, the urging member 22 is exerted on by an external force to pass the top edge of the upholding portion 282, thereby causing the front end of the urging member 22 to connect with the recessed portion of the upholding portion 282. As a result, the door is closed automatically after the door is closed partially at a predetermined angle. When the door is opened, the urging member 22 is caused to disengage the upholding portion 282 so as to urge the periphery of the cam portion 281, thereby causing the door to remain opened at a predetermined angle.

Such a prior art hinge as described above has inherently several shortcomings, which are described hereinafter.

The prior art hinge is rather complicated in construction in that the urging mechanism 16 is made up of the restraining seat 18, two urging members and two elastic elements, and that the urging mechanism 16 can not be therefore made economically.

The two urging members 22 are caused to move axially so as to urge the cam portions 281. As a result, a greater external force is needed to cause the urging members 22 to engage or disengage the upholding portions 282. The door can not be therefore opened smoothly.

The door is often caused to close abruptly in view of the fact that the front end of the urging member 22 is used to urge the cam portion 281, and that the urging member 22 is caused to slide abruptly into the recess of the cam portion 281. The abrupt closing of the door is damaging to the door.

SUMMARY OF THE INVENTION

It is therefore the primary objective of the present invention to provide an improved hinge which is simple in construction and can be therefore made economically.

It is another objective of the present invention to provide an improved hinge with a better urging mechanism of the cam portions.

It is still another objective of the present invention to provide an improved hinge capable of preventing an abrupt closing of the door.

The foregoing objectives of the present invention are attained by an improved hinge comprising a seat, an elastic pressing member, a pivoting member, and a cam member. The seat is provided with a receiving space in which a pivoting end of the pivoting member and the cam member are pivoted such that the pivoting member is capable of turning on the pivoting end acting as a fulcrum, and that a cam portion of the cam member is pressed by the elastic pressing member so as to regulate the angle at which the seat and the pivoting member are caused to intersect.

The foregoing objectives, features and functions of the present invention will be more readily understood upon a thoughtful deliberation of the following detailed description of the present invention in conjunction with the accompanying drawings.

DETAILED DESCRIPTION OF THE INVENTION

Figure 1:
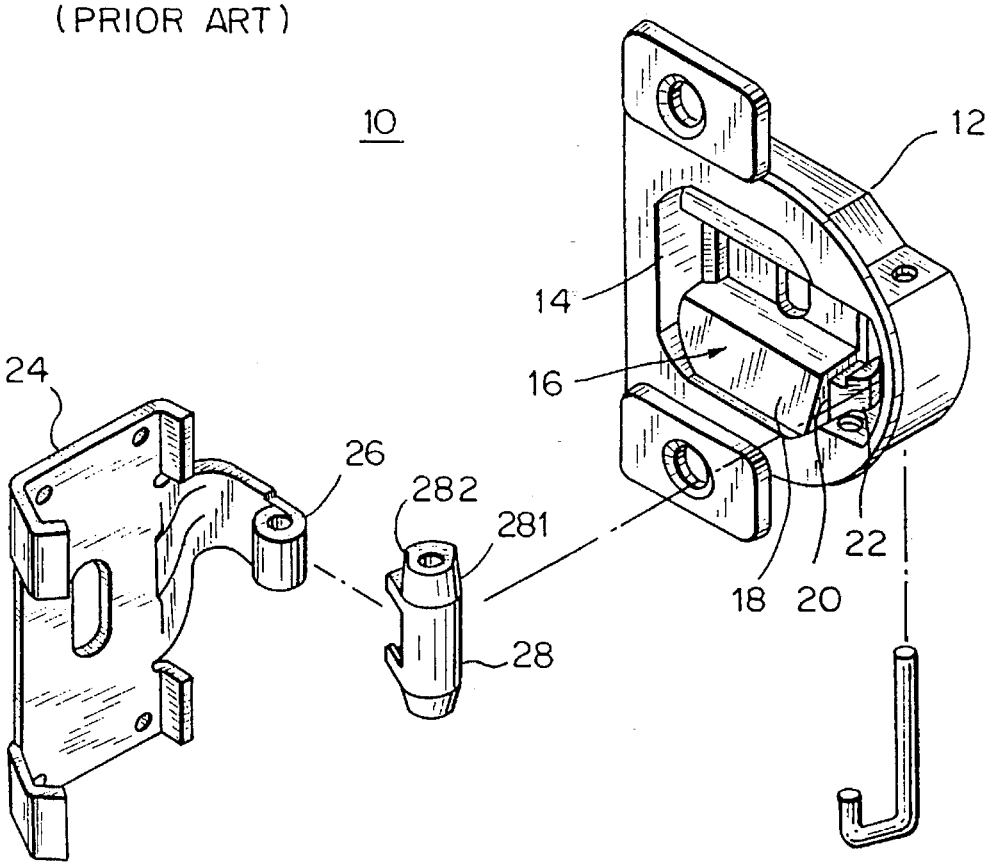
FIG. 1 (PRIOR ART)
FIG. 1 shows a partial exploded view of a hinge of the prior art.
Figure 2:
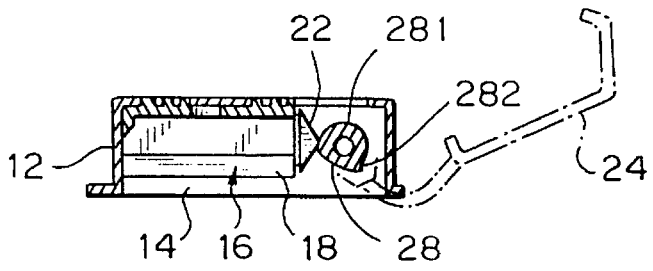
FIG. 2 (PRIOR ART)
FIG. 2 shows a longitudinal sectional view of the prior art hinge in combination.
Figure 4:
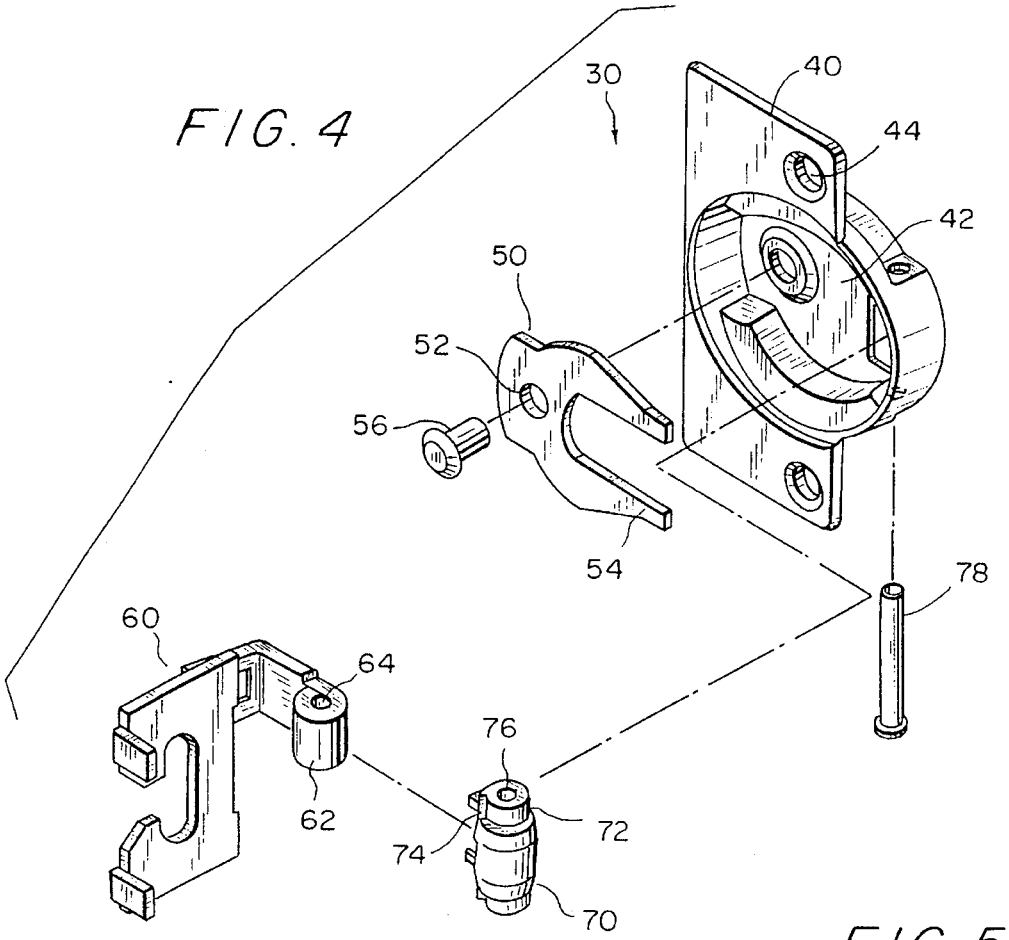
FIG. 4 shows an exploded view of the hinge as shown in FIG. 3.
Figure 3:
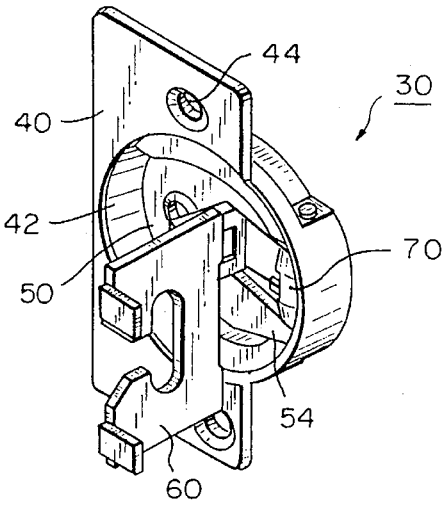
FIG. 3 shows a perspective view of a hinge of the present invention.

As shown in FIGS. 3 and 4, a hinge 30 of the present invention comprises the component parts, which are described hereinafter.

A seat 40 is provided centrally with a receiving space 42 and is further provided respectively in both sides thereof with a pivoting hole 44. The seat 40 is fastened to a door or a piece of furniture by means of a fastener engageable with the pivoting hole 44.

A pressing member 50 of an elastic nature is provided with a through hole 52 and two pressing portions 54 extending outwards and spaced at an interval. The pressing member 50 is fastened to the bottom wall of the receiving space 42 of the seat 40 by a fastening bolt 56.

A pivoting member 60 is provided with a pivoting portion 62 located at one end thereof and provided with an axial hole 64. The pivoting member 60 is fastened to a wall, a door or a piece of furniture.

A cam member 70 of a columnar construction is provided respectively at both ends thereof with a cam portion 72 which has an upholding portion 74. The cam member 70 is further provided with an axial hole 76 and is fastened to the pivoting portion 62 of the pivoting member 60 such that the axial hole 76 of the cam member 70 is opposite to the axial hole 64 of the pivoting portion 62. The pivoting portion 62 and the cam member 70 are pivoted to the receiving space 42 of the seat 40 such that the axial holes 76 and 64 of the cam member 70 and the pivoting portion 62 are engaged with a pivoting pin 78. The two cam portions 72 are pressed by the two pressing portions 54.

Figure 5:
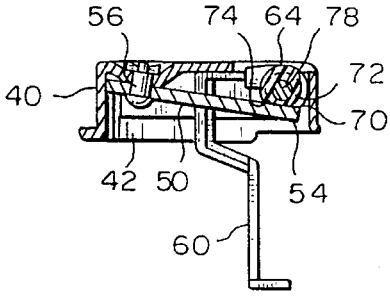
FIGS. 5 and 6 show longitudinal sectional views of the present invention at work.
Figure 6:
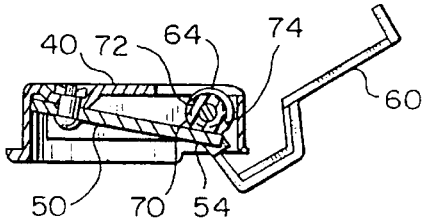

As shown in FIG. 5, when the upholding portion 74 of the cam portion 72 is pressed elastically by the pressing portion 54 of the pressing member 50, the pivoting member 60 and the seat 40 are caused to intersect at a right angle so as to cause the door to close. As the door is opened, the pivoting member 60 is actuated to cause the cam member 70 to turn synchronously, thereby bringing about the movement of the upholding portion 74 of the cam portion 72 away from the position at which the upholding portion 74 is pressed by the pressing portion 54, as shown in FIG. 6. The periphery of the cam portion 72 is therefore pressed by the pressing portion 54 so as to cause the pivoting member 60 to locate at a predetermined angle at which the pivoting member 60 is caused to intersect the seat 40, thereby permitting the door to remain opened at the predetermined angle. When the pivoting member 60 is rotated in reverse, the upholding portion 74 of the cam portion 72 is move closer to the pressing portion 54. After the pressing portion 54 is caused to move past the junction between the peripheries of the upholding portion 74 and the cam portion 72, the pressing portion 54 is caused by its own elastic force to move to press the upholding portion 74, which is then triggered to actuate the cam member 70 and the pivoting portion 62 of the pivoting member 60. As a result, the door is caused to close automatically after the door is moved within the range of a predetermined angle.

The hinge of the present invention described above has several inherent advantages, which are described hereinafter.

The hinge 30 of the present invention is relatively simple in construction and can be therefore made at a relatively low cost in view of the fact that the hinge 30 of the present invention is provided with only one pressing member 50 for use in pressing the cam portions 72.

The cam portion 72 of the present invention is pressed elastically by the pressing portion 54 of the pressing member 50, which is capable of engaging in a curve displacement to enable the pressing portion 54 to disengage smoothly the upholding portion 74. In the meantime, the upholding portion 74 of the cam portion 72 can be pressed by the pressing member 50 without the upholding portion 74 being provided with a bevel or recess.

The abrupt closing of a door is prevented by the curve displacement of the pressing member 50, which takes place at the time when the pressing portion 54 of the pressing member 50 is caused to move past the junction between the peripheries of the upholding portion 74 and the cam portion 72 before the upholding portion 74 is pressed by the pressing portion 54. As mentioned previously, an abrupt closing of a door is damaging to the structural integrity of the door.

What is claimed is:

1. A hinge comprising:

a seat including a receiving space;

a pressing member disposed in said receiving space;

a pivoting member including at one end thereof a pivoting portion;

a cam member having two sides, each of the sides including a respective cam portion each cam portion further including a respective upholding portion, said cam member being pivoted to said pivoting portion of said pivoting member, means for said pivoting member to turn on said pivoting portion acting as a fulcrum by said pivoting portion of said pivoting member and said cam member being pivoted in said receiving space of said seat, and means for pressing said cam portion of said cam member elastically by said pressing member, said means for pressing including means for regulating an angle at which said seat and said pivoting member are caused to intersect;

wherein said pressing member includes an elastic pressing piece having a body provided at one side thereof with two pressing portions which are extended outwards and are spaced at an interval such that said two pressing portions correspond in location to said two cam portions of said cam member.

2. The hinge according to claim 1 wherein said pressing member includes a body fastened to a bottom wall of said receiving space of said seat.

* * * * *